US007573424B2

(12) United States Patent
Mei

(10) Patent No.: US 7,573,424 B2
(45) **Date of Patent: *Aug. 11, 2009**

(54) DUAL-BAND ANTENNA FOR RADIATING ELECTROMAGNETIC SIGNALS OF DIFFERENT FREQUENCIES

(75) Inventor: Chia-Hao Mei, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 281 days.

This patent is subject to a terminal disclaimer.

(21) Appl. No.: 11/308,575

(22) Filed: Apr. 8, 2006

(65) Prior Publication Data

US 2007/0040748 A1 Feb. 22, 2007

(30) Foreign Application Priority Data

Jun. 10, 2005 (CN) ..... 2005 1 0035292

(51) Int. Cl.
*H01Q 1/38* (2006.01)

(52) U.S. Cl. ..... 343/700 MS; 343/702; 343/846

(58) Field of Classification Search ..... 343/700 MS, 343/702, 829, 846, 848
See application file for complete search history.

(56) References Cited

U.S. PATENT DOCUMENTS 6,246,371 B1 * 6/2001 Kurz et al. ..... 343/702
6,515,629 B1 2/2003 Kuo et al.
6,535,170 B2 * 3/2003 Sawamura et al. ..... 343/702
6,600,450 B1 * 7/2003 Efanov et al. ..... 343/726
2002/0070902 A1 * 6/2002 Johnson et al. ..... 343/702
2004/0041733 A1 * 3/2004 Milosavljevic ..... 343/700 MS
2004/0246180 A1 * 12/2004 Okado ..... 343/700 MS
2006/0279464 A1 * 12/2006 Mei ..... 343/700 MS

FOREIGN PATENT DOCUMENTS

JP 2002-158529 A 5/2002
JP 2003-188637 A 7/2003
JP 2004-147282 A 5/2004
JP 2004-247791 A 9/2004
WO WO 01/45204 A1 6/2001
WO WO 01/80355 A1 10/2001

* cited by examiner

*Primary Examiner*—Tho G Phan
(74) *Attorney, Agent, or Firm*—Wei Te Chung

(57) ABSTRACT

A dual-band antenna for radiating electromagnetic signals of different frequencies includes a ground portion (500), a feeding part (400), and a body (100). The feeding part (400) is for feeding signals. The body (100) includes a first radiating part (110) and a second radiating part (120). The first radiating part includes a bent portion (115), a first free end (111), and a first connecting end (112). The bent portion (115) is between the first free end (111) and the first connecting end (112). The first connecting end (111) is electronically connected to the feeding part (400). The second radiating part (120) includes a second connecting end (122) and a second free end (121). The second connecting end (122) is connected to the first connecting end (112). The shorting part (200) is between the body (100) and the ground portion (500).

15 Claims, 7 Drawing Sheets

DUAL-BAND ANTENNA FOR RADIATING ELECTROMAGNETIC SIGNALS OF DIFFERENT FREQUENCIES

FIELD OF THE INVENTION

The invention relates to antennas such as those used in office equipment and portable electronic devices, and particularly to dual-band antennas for radiating electromagnetic signals of different frequencies.

DESCRIPTION OF RELATED ART

Due to increasing market demand for mobile communication products, the development of wireless communication products and systems has rapidly advanced. Many wireless communication standards have been drawn up and implemented. Perhaps the most appealing standard is 802.11, drawn up by the Institute of Electrical and Electronics Engineers (IEEE) in 1997. The IEEE 802.11 standard provides many new functions regarding wireless communication, and provides many new methods for communication between wireless communication products of different companies.

In August 2000, the IEEE amended 802.11 such that 802.11 became a joint standard of the Institute of Electrical and Electronics Engineers (IEEE), the American National Standards Institute (ANSI) and the International Standard Organization (ISO). Furthermore, two more important protocols were added: IEEE 802.11a and IEEE 802.11b. IEEE 802.11a and 802.11g products are expected to work at the dual frequencies of 5 GHz and 2.4 GHz, respectively. Therefore, if a wireless communication product uses the two protocols simultaneously, more than one antenna is required. The addition of one or more antennas, however, not only increases the base cost and installation cost of the communication product, but also means that the communication product occupies more space. This makes it very difficult to reduce the overall size of the wireless communication product to a more convenient size.

SUMMARY OF THE INVENTION

An exemplary embodiment of the invention provides a dual-bend antenna for radiating electromagnetic signals of different frequencies. The dual-band antenna includes a ground portion, a feeding part, and a body. The feeding pan is for feeding signals. The body includes a first radiating part and a second radiating part. The first radiating part includes a bent portion, a first free end, and a first, connecting end. The bent portion is between the first free end and the first connecting end. The first connecting end is electrically connected to the feeding part. The second radiating part includes a second connecting end and a second free end. The second connecting end is connected to the first connecting end. The above-described configuration can effectively reduce the size of the dual-band antenna.

Other advantages and novel features will become more apparent from the following detailed description when taken in conjunction with the accompanying drawings, in which:

DETAILED DESCRIPTION

Figure 1:
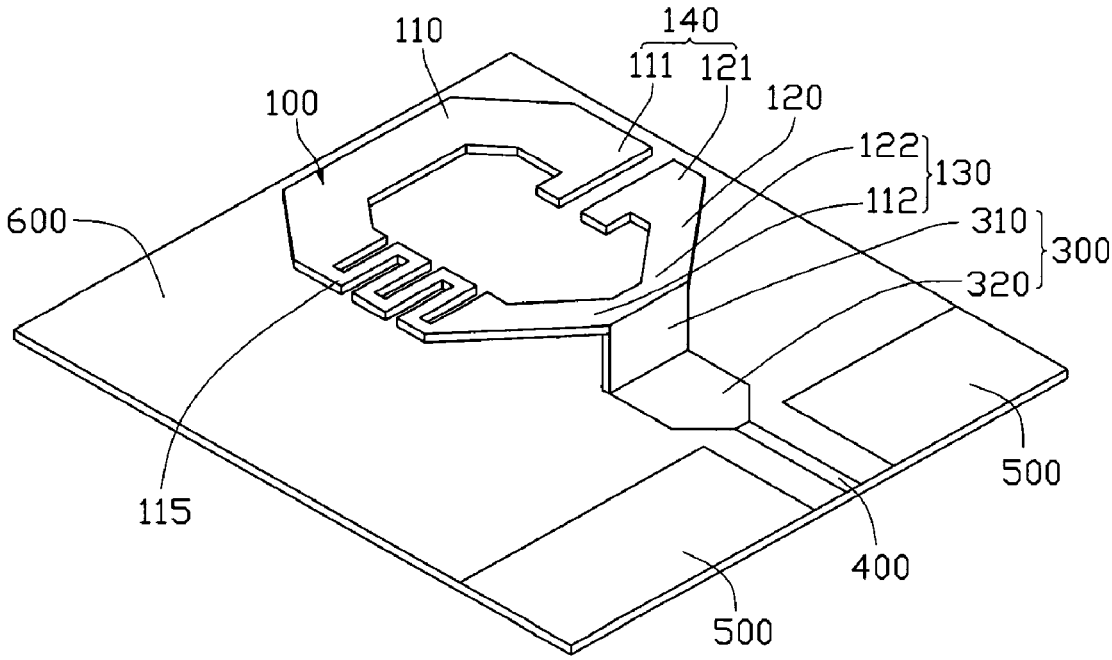
FIG. 1 is a schematic, isometric view of a first exemplary embodiment of a dual-band antenna of the present invention.

FIG. 1 is a schematic, isometric view of a dual-band antenna of a first exemplary embodiment of the present invention. In the first exemplary embodiment, the dual-band antenna is disposed on a substrate 600, and includes a body 100, a supporting conductor 300, a feeding part 400, and two ground portions 500. In another exemplary embodiment, the dual-band antenna may not include the supporting conductor 300. In the first exemplary embodiment the substrate 600 is a Printed Circuit Board (PCB). The feeding part 400 is used for feeding signals. The ground portions 500 are disposed on the substrate 600 on two opposite sides of the feeding part 400 respectively. The body 100 is generally shaped as a polygon, for example, a hexagon, with a gap, and includes a first radiating part 110 and a second radiating part 120. In the first exemplary embodiment, the body 100 is made of metal, and the first radiating part 110 and the second radiating part 120 are formed integrally as a single piece. The first radiating part 110 includes a first free end 111 with a first protrusion defined at a side of the first free end 111, a first connecting end 112, and a bent portion 115. The bent portion 115 is disposed between the first free end 111 and the first connecting end 112. The first protrusion noints toward the bent portion 115. In the first exemplary embodiment, the bent portion 115 is concertinaed. This configuration is also known as a comb-line structure. In the illustrated embodiment, the bent portion 115 is angular; i.e., sharp-cornered. In another exemplary embodiment, the bent portion 115 may be curved, with rounded corners or portions. In still another exemplary embodiment, the bent portion 115 may be both angular and curved; that is, the bent portion 115 may have a combination of angular corners or portions and curved comets or portions.

The second radiating part 120 includes a second free end 121 with a second protrusion defined at a side of the second free end 121, and a second connecting end 122. The second protrusion points toward the bent portion 115. The second connecting end 122 is connected to the first connecting end 112, thereby cooperatively forming a joint portion 130. The first free end 111 and the second free end 121 respectively terminate the first radiating part 110 and the second radiating part 120, with the first free end 111 and the second free end 121 opposing each other across a gap therebetween. The first free end 111 and the second free end 121 thereby cooperatively define a capacitive load 140 therebetween. The supporting conductor 300 supports the body 100 above the substrate 600. The supporting conductor 300 includes a vertical part 310, and an adjoining horizontal part 320 on the substrate 600. The vertical part 310 is electrically connected to the Joint portion 130, and the horizontal pelt 320 is electrically connected to the feeding part 400. In another exemplary embodiment, the bent portion 115 may be curved, with rounded corners or portions. In still another exemplary embodiment, the bent portion 115 may be both angular and curved; that is, the bent portion 115 may have a combination of angular corners or portions and curved corners or portions.

A length of the first radiating part 110 is greater than that of the second radiating part 120. Therefore the first radiating part 110 is operated at a lower frequency band, and the second radiating part 120 is operated at a higher frequency band. In the first exemplary embodiment, the first radiating part 110 can be operated at 2.45 GHz (IEEE 802.11b/g), and the second radiating part 120 can be operated at 5 GHz (IEEE 802.11a), such that the frequency bands of the dual-band antenna can conform to IEEE 802.11a/b/g.

The capacitive load 140 can produce an electromagnetic field effect. The electromagnetic field effect can be shared by both of the lower frequency band and the higher frequency band, so that a resonance length of the lower frequency band and the higher frequency band can be effectively reduced. Therefore, the size of the dual-band antenna is effectively reduced. In addition, the bent portion 115 can reduce the rectilinear length of the first radiating part 110 between the first free end 111 and the first connecting end 112 as long as the first radiating part 110 keeps resonating. Therefore, the size of the dual-band antenna is effectively further reduced. Furthermore, the bent portion 115 can produce a coupling effect, thereby strengthening the radiation pattern of the dual-band antenna.

Figure 2:
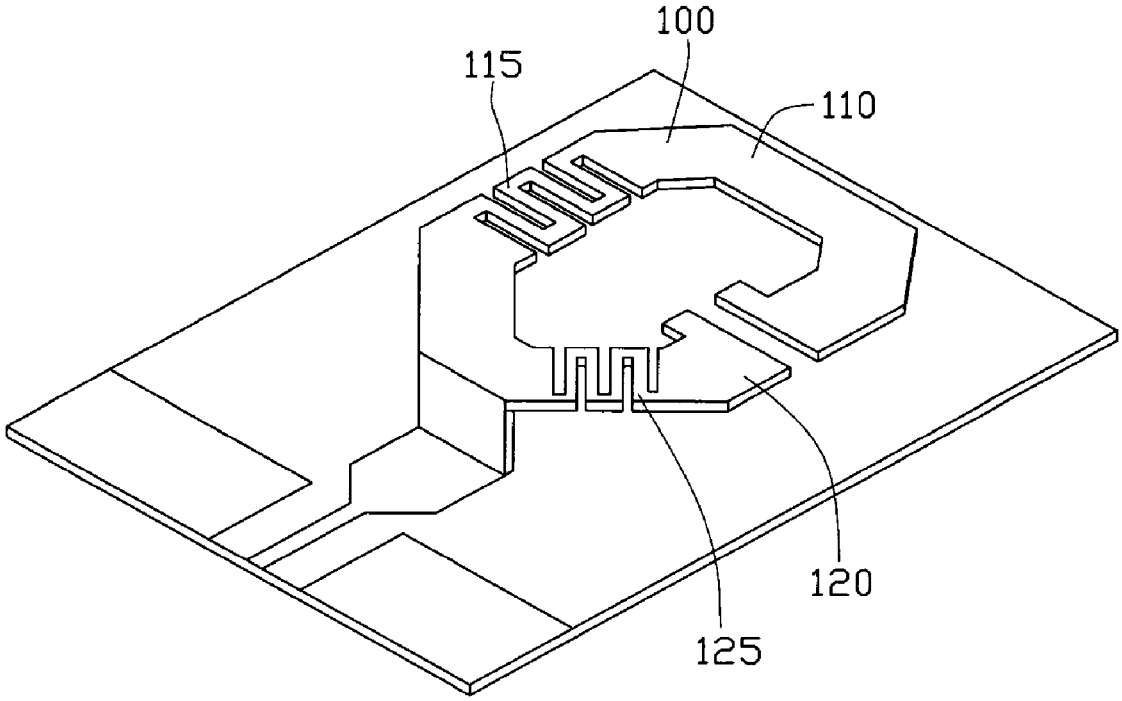
FIG. 2 is a schematic, isometric view of a second exemplary embodiment of a dual-band antenna of the present invention.

FIG. 2 is a schematic, isometric view of a dual-band antenna of a second exemplary embodiment of the present invention. The second exemplary embodiment is similar to the first exemplary embodiment described above. However, the second radiating part 120 includes a bent portion 125, which has the same function as the bent portion 115 of the first radiating part 110. Therefore, the bent portion 125 can effectively reduce the size of the dual-band antenna.

Figure 3:
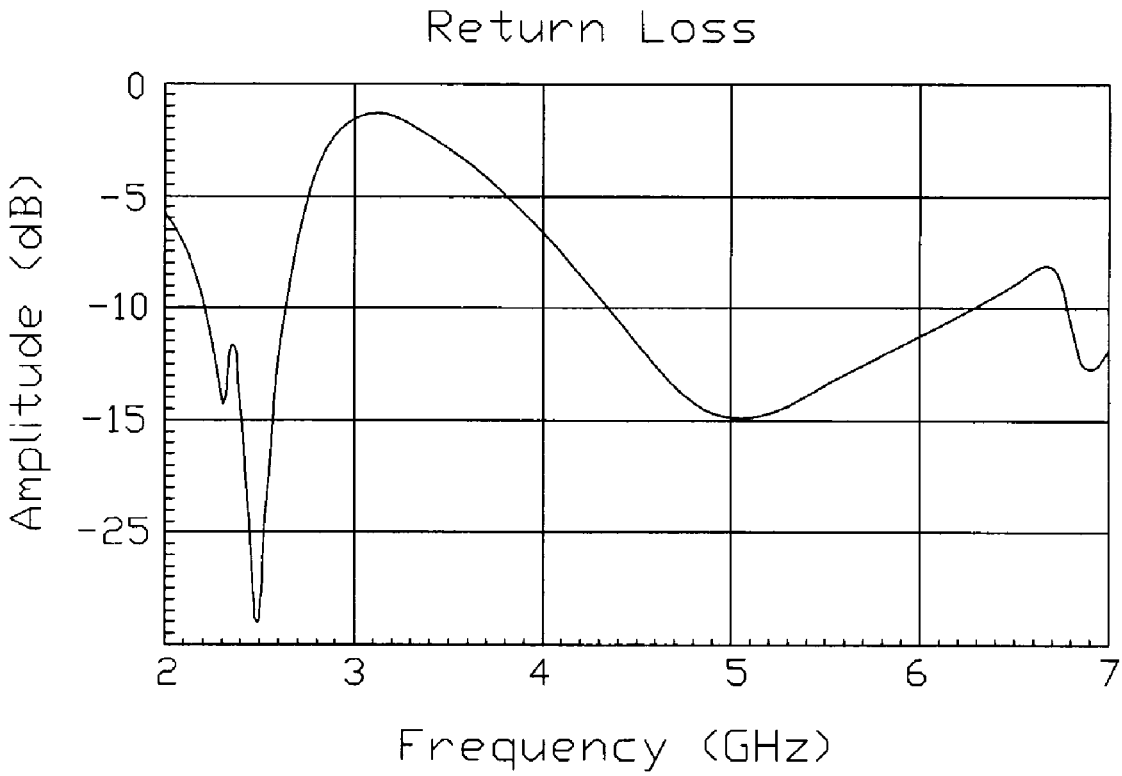
FIG. 3 is a graph of test results showing return loss of the dual-band antenna of FIG. 1.
Figure 4:
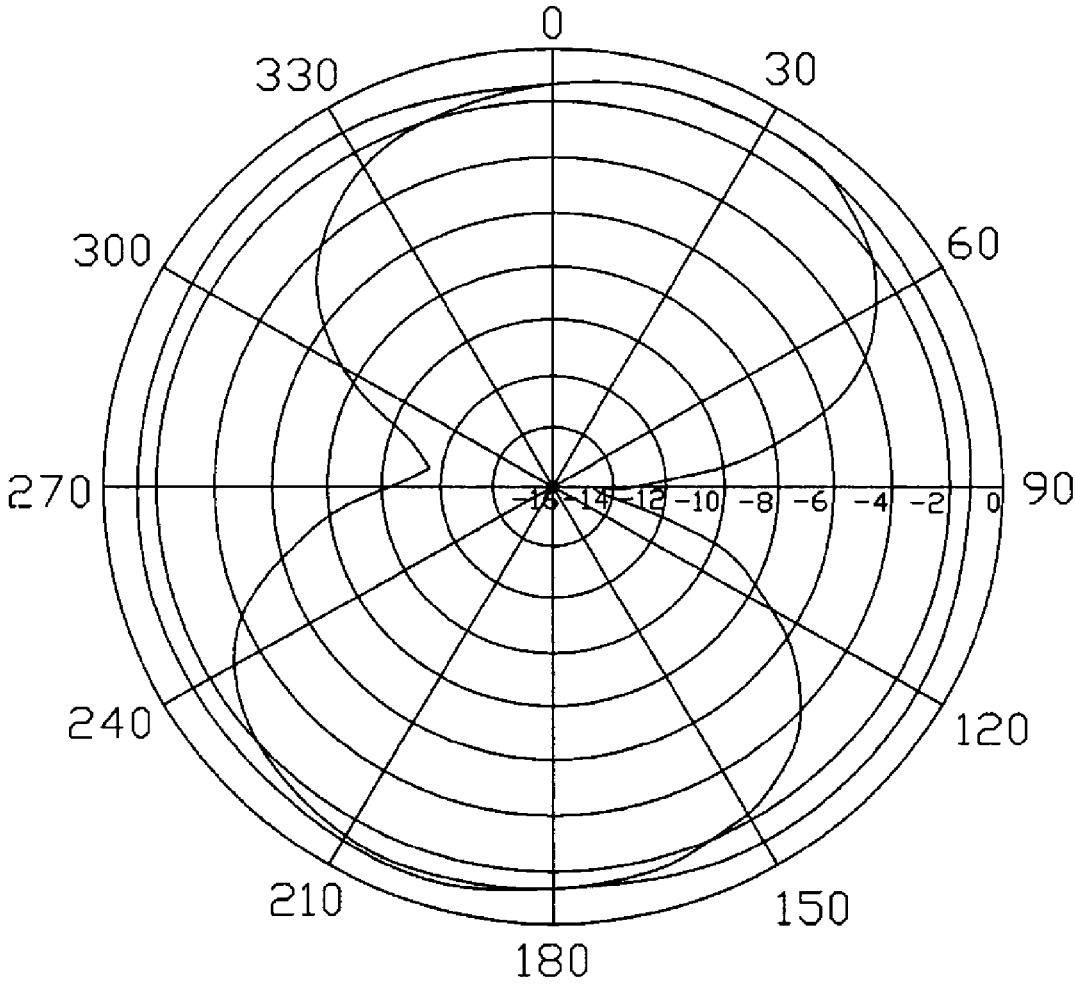
FIG. 4 is a graph of test results showing a radiation pattern when the dual-band antenna of FIG. 1 is operated at 2.45 GHz.
Figure 5:
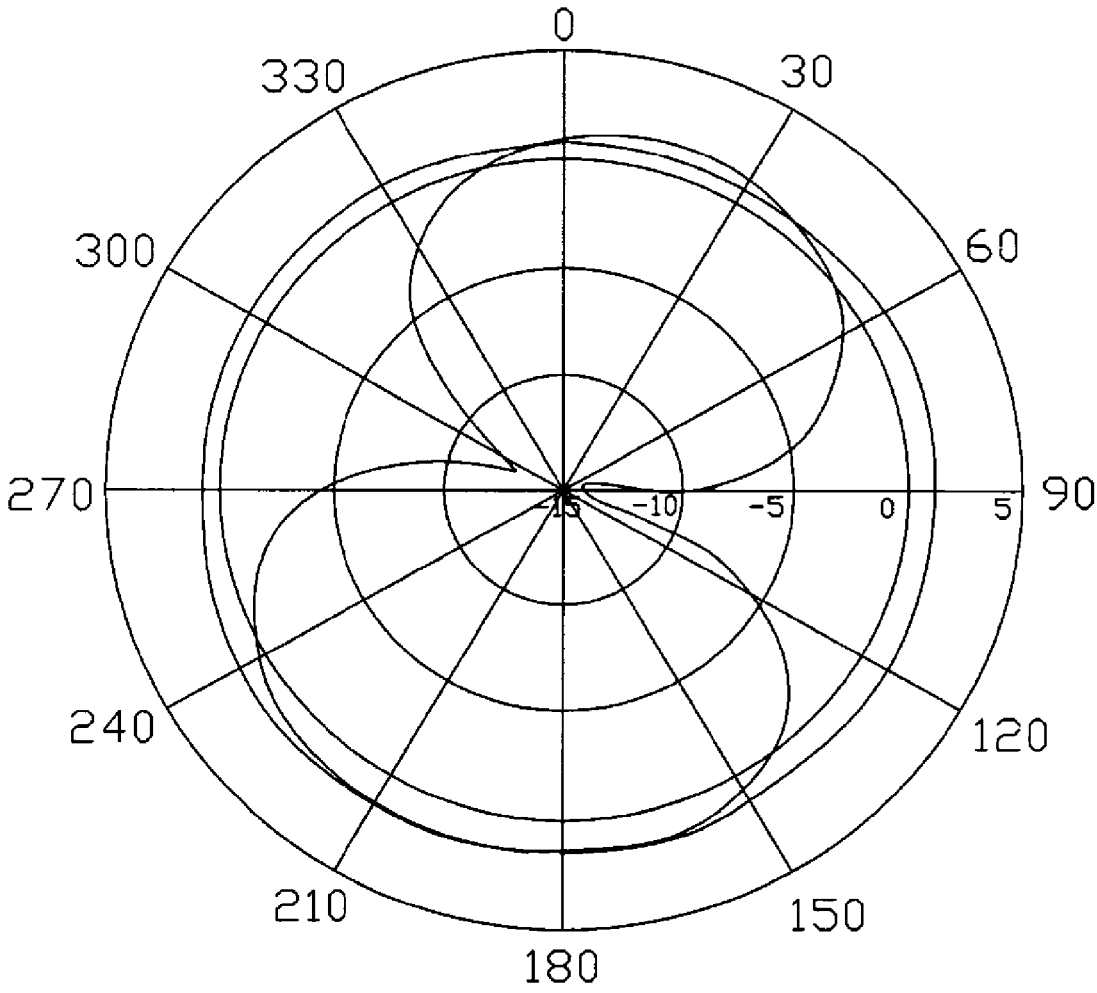
FIG. 5 is a graph of test results showing a radiation pattern when the dual-band antenna of FIG. 1 is operated at 5.0 GHz.
Figure 6:
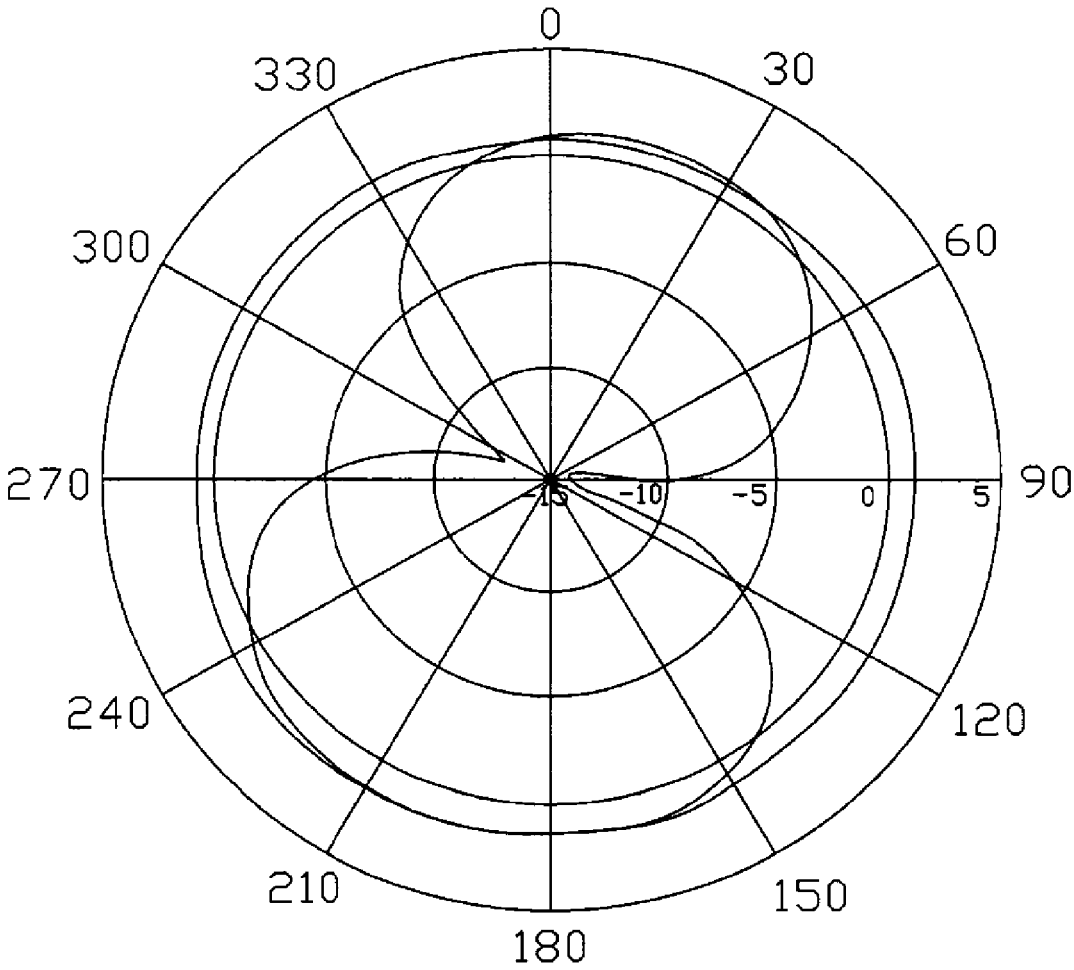
FIG. 6 is a graph of test results showing a radiation pattern when the dual-band antenna of FIG. 1 is operated at 5.5 GHz.
Figure 7:
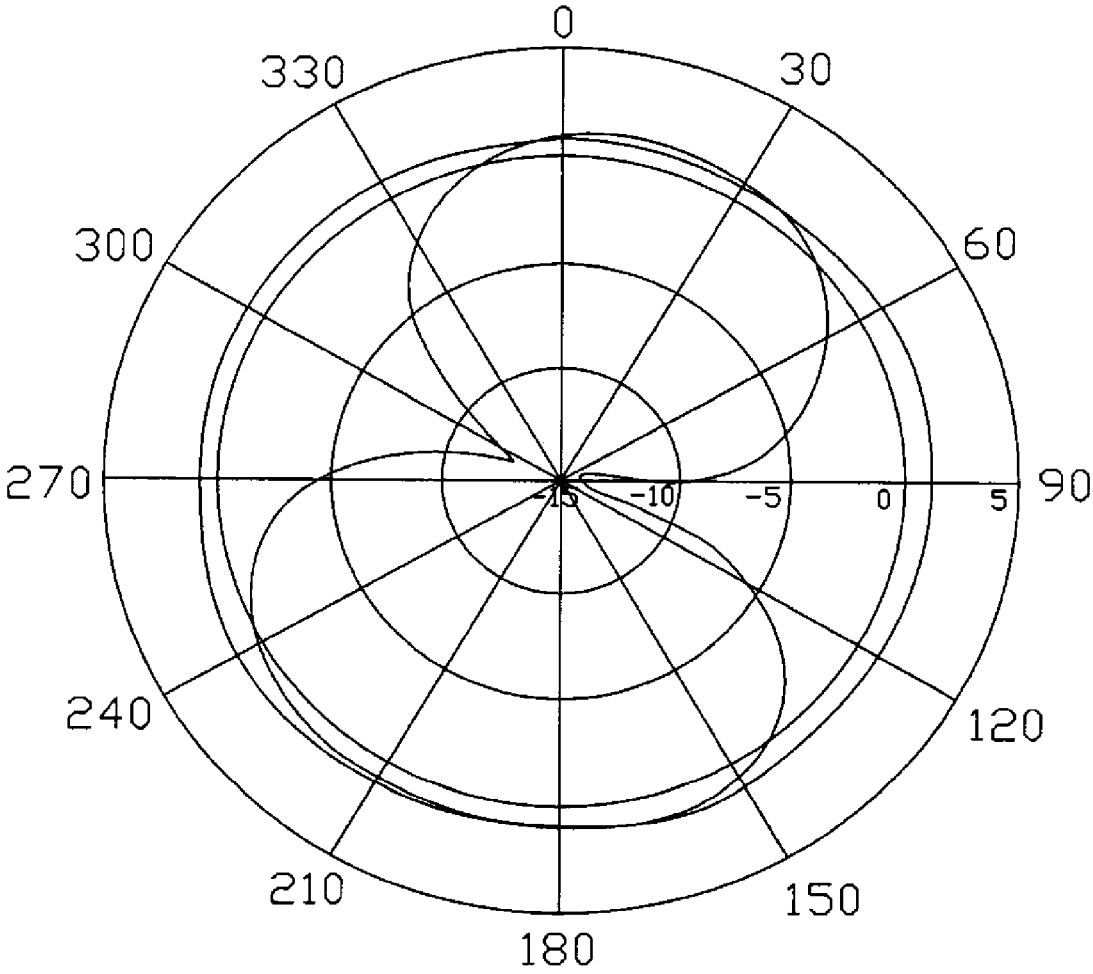
FIG. 7 is a graph of test results showing a radiation pattern when the dual-band antenna of FIG. 1 is operated at 6.0 GHz.

FIG. 3 is a graph of test results showing return loss of the dual-band antenna of the first exemplary embodiment. As shown, the dual-band antenna can be operated at a first frequency band of 2.45 GHz and a second frequency band of 5 GHz. For example, when the dual-band is used in a Wireless Local Network, the first frequency band can conform to IEEE 802.11b/g, and the second frequency band can conform to IEEE 802.11a.

FIGS. 4-7 show radiation patterns when the dual-band antenna of the first exemplary embodiment is operated at 2.45 GHz, 5.0 GHz, 5.5 GHz, and 6.0 GHz respectively. As seen, all of the radiation patterns are substantially omni-directional.

Although various embodiments have been described above, the structure of the dual-band antenna should not be construed to be limited for use in respect of IEEE 802.11 only. When the size and/or shape of the dual-band antenna is changed or configured appropriately, the dual-band antenna can function according to any of various desired communication standards or ranges. Further, in general, the breadth and scope of the invention should not be limited by the above-described exemplary embodiments, but should be defined only in accordance with the following claims and their equivalents.

What is claimed is:

1. A dual-band antenna for radiating electromagnetic signals of different frequencies, comprising:

a ground portion;

a feeding part adjacent to the ground portion, for feeding signals;

a body electrically connected to the feeding part, the body being substantially shaped as a polygon with a gap, the body comprising:

a first radiating part comprising a first free end, a first connecting end electrically connected to the feeding part, and a bent portion disposed between the first free end and the first connecting end, the bent portion having a selective one of an angular concertinaed configuration and a curved concertinaed configuration; and a second radiating part, comprising a second connecting end electrically connected to the first connecting end, and a second free end;

wherein the gap is sandwiched between the first free end and the second free end, and at least one of the first and second free ends comprising a protrusion formed at a side thereof to point toward the bent portion.

2. The dual-band antenna as claimed in claim 1, further comprising a supporting conductor between the body and the feeding part, for supporting the body.

3. The dual-band antenna as claimed in claim 2, wherein the supporting conductor includes a vertical part, and a horizontal part adjoining the vertical part.

4. The dual-band antenna as claimed in claim 3, wherein the vertical part is electrically connected to a joint portion of the first connecting end and the second connecting end.

5. The dual-band antenna as claimed in claim 3, wherein the horizontal part is electrically connected to the feeding part.

6. The dual-band antenna as claimed in claim 1, wherein a length of the first radiating part is greater tan that of the second radiating part.

7. The dual-band antenna as claimed in claim 1, wherein the second radiating part further comprises a bent portion between the second connecting end and the second free end.

8. The dual-band antenna as claimed in claim 1, wherein the first free end and the second free end terminate the first radiating part and the second radiating part, respectively.

9. The dual-band antenna as claimed in claim 1, wherein the first radiating part and the second radiating part are formed integrally as a single piece.

10. The dual-band antenna as claimed in claim 1, wherein the body is substantially shaped as a hexagon with the gap.

11. A dual-band antenna comprising:

a body of said antenna comprising a first part for radiating and receiving first signals compatible with a first signal standard, and a second part for radiating and receiving second signals compatible with a second signal standard, one extending end of said first part and one extending end of said second part electrically connectable with a joint portion of said body, another extending end of said first part and another extending end of said second part parallel spaced from each other so as to exclusively generate electrically capacitive performance between said first and second parts, said body further comprising a bent portion disposed between said joint portion and said another extending end of said first part, at least one of said another extending ends of said first and second parts defining a protrusion at a side thereof and said protrusion pointing toward said bent portion; and a feeding part electrically connectable with said joint portion so as to transmit said first signals via said first part of said body and transmit said second signals via said second part of said body respectively.

12. The dual-band antenna as claimed in claim 11, wherein said first part is longer than said second part, and said first part and said second part extend to substantially surround a void space therebetween so as to commonly form a hexagon shape.

13. A dual-band antenna comprising:

a body of said antenna defining a void in a center thereof to commonly form a polygon, said body comprising a joint portion, and a first part and a second part branching out of said joint portion, said first part capable of radiating and receiving first signals compatible with a first signal standard and said second part capable of radiating and receiving second signals compatible with a second signal standard, a distal end of said first part and a distal end of said second part extending to confront and be spaced from each other, and being commonly arranged along a first side of said polygon so as to generate capacitive performance thereat, said body of said antenna further comprising a bent portion disposed between said joint portion and said distal end of said first part, said bent portion extending along a second side of said polygon parallel to said first side of said polygon; and a feeding part electrically connectable with said joint portion so as to transmit said first signals via said first part of said body and transmit said second signals via said second part of said body respectively.

14. The dual-band antenna as claimed in claim 13, wherein at least one of said distal ends of said first and second parts defines a protrusion at a side thereof and said protrusion points toward said bent portion.

15. The dual-band antenna as claimed in claim 13, wherein said polygon is a hexagon.

* * * * *